US005278036A

United States Patent [19]

Kobayashi et al.

[11] Patent Number: 5,278,036

[45] Date of Patent: Jan. 11, 1994

[54] PHOTOGRAPHIC DEVELOPER COMPOSITION

[75] Inventors: Akira Kobayashi; Kenichi Tanaka, both of Hino, Japan

[73] Assignee: Konica Corporation, Tokyo, Japan

[21] Appl. No.: 938,994

[22] Filed: Sep. 2, 1992

[30] Foreign Application Priority Data

Sep. 24, 1991 [JP] Japan ..... 3-243380
Sep. 24, 1991 [JP] Japan ..... 3-243382

[51] Int. Cl.[5] ..... G03C 5/305

[52] U.S. Cl. ..... 430/465; 430/486; 430/957

[58] Field of Search ..... 430/465, 486, 957

[56] References Cited

U.S. PATENT DOCUMENTS

| | | | |
|---|---|---|---|
| 2,196,901 | 4/1940 | Ham | 430/456 |
| 3,972,719 | 8/1976 | Vanreusel et al. | 430/266 |
| 5,085,971 | 2/1992 | Katoh et al. | 430/957 |
| 5,135,840 | 8/1992 | Reuter et al. | 430/465 |
| 5,188,927 | 2/1993 | Okada et al. | 430/465 |

FOREIGN PATENT DOCUMENTS

| | | |
|---|---|---|
| 2455002 | 5/1975 | Fed. Rep. of Germany . |
| 3312206 | 10/1983 | Fed. Rep. of Germany . |
| 2286415 | 4/1976 | France . |

*Primary Examiner*—Hoa Van Le
*Attorney, Agent, or Firm*—Frishauf, Holtz, Goodman & Woodward

[57] ABSTRACT

A composition for developing a silver halide photographic light-sensitive material is disclosed. The composition has a form of a tablet or granule and comprises an organic development inhibitor having a solubility of not higher than 1 % by weight in an aqueous medium having a pH value of 6 to 12, and a water-soluble or alkali-soluble polymer having a melting point of 30° C. to 100° C. in an amount of not less than 5% by weight of total weight of the composition. The granules or tableted composition of the invention is preferably produced in a process comprising steps of (1) melting the polymer, (2) dissolving the organic development inhibitor in the melted polymer, (3) mixing the melted polymer containing the component with the remaining components of the composition, and (4) granulating or tableting the mixed composition. The composition is friendly for environment and is excellent in stability, conservability.

6 Claims, No Drawings

PHOTOGRAPHIC DEVELOPER COMPOSITION

FIELD OF THE INVENTION

The present invention relates to a new processing agent for silver halide photographic light-sensitive materials.

BACKGROUND OF THE INVENTION

Traditionally, processing compositions for silver halide photographic light-sensitive materials are used in the form of liquid or powder. When the processing composition is liquid, it is used as such or after being mixed with water in an optionally selected ratio. When it is powder, it is used after being dissolved in water.

However, in the case of liquid compositions, the presence of water therein increases both volume and weight, thus posing problems related to transportation cost and liquid leakage and other safety concerns, though they are easy to dissolve. In addition, when a large amount is handled, great weight is a significant burden on the user. In the case of powder agents, powder scattering poses a problem related to the working environment, though they much surpass liquid compositions in compactness.

Also, both liquid and powder compositions pose a problem of environmental pollution upon disposal due to the residence of the liquid or powder in the packing material after solution preparation.

To solve these problems, a number of methods wherein the processing composition is granulated or tableted are under investigation in the photographic industry.

In the production of granules or tablets, it is a common practice to uniformly mix a small amount of water and binders such as starch, polyvinyl alcohol, cellulose and gelatin, which binders are used to ensure a sufficient level of strength of the granules or tablets obtained, with the base components and either granulate the mixture by extrusion granulation, mixing stirring granulation or another granulating method or tablet the mixture by compressive forming. Then, the residual water is removed through the drying process to yield a finished product.

However, granulation using water is undesirable for photographic processing components, especially developing components, because their storage stability is significantly affected by the residual water therein. Although the residual water content can be reduced by drying, drying deteriorates the strength of granules or tablets, which can lead to dust formation due to vibrating destruction during transportation and poses a problem similar to that occurring in powder processing compositions, and more importantly, it raises production cost considerably.

A photographic processing composition usually contains organic compounds such as a developing agent, a developing inhibitor, a developing accelerator, an anti-silver sludge agent and a gamma value regulator. With the recent technical improvements, the number of organic compounds used and the number of their kinds have tended to increase.

In the case of liquid processing compositions, organic solvents can be used, in which the above-mentioned organic compounds can be dissolved, which offers a great advantage over powder processing compositions. However, although organic solvents can be present at several percentages of the total amount of base components, this amount is insufficient to dissolve the above-mentioned organic compounds; increasing the organic solvent content deteriorates the mechanical strength and storage stability of granules or tablets. Moreover, the use of a large amount of organic solvent is also undesirable from the point of view of environmental protection.

SUMMARY OF THE INVENTION

The object of the present invention, developed to overcome the problems described above, is to provide an environmentally friendly photographic processing agent with excellent storage stability which is excellently stable and unlikely to deposit.

The above object of the invention is accomplished by a developer composition for a silver halide photographic lightsensitive material being tableted or granulated which comprises an organic development inhibitor having a solubility of not higher than 1% by weight in an aqueous medium having a pH value of 6 to 12, and a water-soluble or alkali-soluble polymer having a melting point of 30° C. to 100° C. in an amount of not less than 5% by weight of the total weight of the composition.

The granules or tableted composition of the invention is preferably produced in a process comprising steps of (1) melting the polymer, (2) dissolving the development inhibitor in the melted polymer, (3) mixing the melted polymer containing the development inhibitor with the remaining components of the composition, and (4) granulating or tableting the mixed composition.

DETAILED DESCRIPTION OF THE INVENTION

Examples of water-soluble or alkali-soluble polymers for the present invention include polyalkylene glycols such as polyethylene glycol, polyvinyl alcohol, polyvinylpyrrolidone, polyoxyethylene alkyl ethers such as polyoxyethylene cetyl ether and polyoxyethylene stearyl ether, polyoxyethylene alkyl phenol ethers such as polyoxyethylene octyl phenol ether and polyoxyethylene nonyl phenol ether and the water-soluble binders described in Japanese Patent Application No. 203165/1990.

The polymers have a melting point of from 30° C. to 100° C. preferably 40° C. to 100° C.

Although the amount of soluble polymer used for the present invention varies depending on the nature of the polymer used and the solubility and strength of the necessary granules or tablets (hereinafter referred to as granulation product), it is normally not less than 5% by weight, preferably 5 to 40% by weight of the total amount of processing compositions to be granulated or tableted.

Examples of organic development inhibitors for the present invention, whose solubility in water or alkali is not more than 1% by weight, include the following compounds and derivatives thereof. The inhibitor is usually contained in a processing composition of the invention in a content of not more than 1% by weight of the total weight of the composition.

1. Benzotriazole
2. Benzimidazole
3. Benzothiazole
4. Indazole
5. Quinoline
6. Cinnoline 7. Purine
8. Tetrazole
9. Triazole
10. Imidazole
11. Thiazole
12 Naphthalene Preparation of the granulated or tableted processing composition of the invention preferably performed by a procedure comprising the following steps. (1) Melting the above water-soluble or alkali-soluble polymer with heating, (2) dissolving the organic development inhibitor component, in the melted polymer, (3) mixing the melted polymer, in which the above organic development inhibitor is dissolved, with the remaining components of the composition, and (4) granulating or tableting the mixed composition.

Granulating methods usable for the present invention include tumbling granulation, extrusion granulation, compressive granulation, disintegrating granulation, agitating granulation, spray drying, and melting solidification, with preference given to extrusion granulation and compressive granulation.

Although the size and shape of a granulation product suitable for the present invention vary depending on the desired properties, grain size is normally about 0.1 to 10 mm, preferably about 0.5 to 5 mm for granules, and their shape may be cylindrical, spherical, cubic, cuboid, etc., with preference given to spherical or cylindrical shape, in view of the generally desired solubility for photographic processing agents, the amount of residual powder in the packing material waste after solution preparation and the durability of the granulation product against mechanical destruction due to vibration during transportation.

The same applies to tablets, but their diameter is preferably about 5 mm to 5 cm. For improving solubility, tabular tablets with reduced thickness, tabular tablets with further reduced central thickness and hollow donut tablets are also useful. Diameter may be further increased optionally to achieve slow dissolution.

Also, surface conditions (smoothness, porosity, etc.) may be changed to control solubility.

It is also possible to provide different solubilities for a number of granulation products or to take a number of shapes to match the solubilities of materials with different solubilities. The granulation product may also have a multiple layer structure wherein composition differs between the surface and the inside.

Any known photographic processing agent can be used for the present invention without limitation.

EXAMPLES

Example 1

Preparation of Light-Sensitive Material Sample

Preparation of Emulsion A

A silver chlorobromide emulsion was prepared using the following solutions A, B and C.

| | |
|---|---|
| Solution A | |
| Ossein gelatin | 17 g |
| 10% ethanol solution of sodium salt of polyisopropylene-polyethyleneoxide succinic acid ester | 5 ml |
| Distilled water | 1280 ml |
| Solution B | |
| Silver nitrate | 170 g |
| Distilled water | 410 ml |

-continued

| | |
|---|---|
| Solution C | |
| Sodium chloride | 45.0 g |
| Potassium bromide | 27.4 g |
| Rhodium trichloride trihydrate | 28 μg |
| 10% ethanol solution of sodium salt of polyisopropyleneoxide succinic acid ester | 3 ml |
| Ossein gelatin | 11 g |
| Distilled water | 407 ml |

Sodium chloride was added to solution A being kept at 40° C. to reach an EAg value of 160 mV.

Next, using the mixer stirrer described in Japanese Patent Publication Open to Public Inspection (hereinafter referred to as Japanese Patent O.P.I. Publication) Nos. 92523/1982 and 92524/1982, solutions B and C were added by the double jet method. Addition flow rate was gradually increased in proportion to the surface area of the silver halide formed, while keeping the EAg value constant. The EAg value was changed from 160 mV to 120 mV by the addition of a 3 ml/l aqueous solution of sodium chloride 5 minutes after initiation of addition, after which this level was maintained until completion of mixing. To keep the EAg value constant, a 3 mol/l aqueous solution of sodium chloride was added.

EAg values were determined using a metallic silver electrode and a double-junction type saturated Ag-/AgCl reference electrode (the electrode configuration was the double junction disclosed in Japanese Patent O.P.I. Publication No. 197534/1982). During addition, the emulsion was sampled and confirmed to involve no new grain formation in the system by electron microscopy.

During addition, a 3% aqueous solution of nitric acid was added to have a constant pH level of 3.0. After completion of addition of solutions B and C, the emulsion was subjected to Ostwald ripening for 10 minutes, after which it was desalinized and washed by ordinary methods. Then, 600 ml of an aqueous solution of ossein gelatin (30 g ossein gelatin contained) was added, followed by stirring dispersion at 55° C. for 30 minutes, and the dispersion was diluted to 750 ml.

After gold-sulfur sensitization of emulsion A, sensitizing dye A in an amount of 300 mg per mol of the silver halide contained in the emulsion, and 4-hydroxy-6-methyl-1,3,3a, 7-tetrazaindene, as a stabilizer, were added, and sensitizing dye B was added in an amount of 100 mg per mol of the silver halide contained in the emulsion.

Next, the following compound C in an amount of 800 mg per mol of silver halide was added, and then 300 mg of sodium p-dodecylbenzenesulfonate, 2 g of styrene-maleic acid copolymer and 15 g of styrene-butyl acrylate-acrylic acid copolymer latex (average grain size about 0.25 μm) were added. The resulting mixture was coated on a polyethylene terephthalate film base subbed as described in Example 1 of Japanese Patent O.P.I. Publication No. 19941/1984 so that the amounts of Ag and gelatin coated would be 4.0 g/m$^2$ and 2.00 g/m$^2$, respectively. Simultaneously, a protective layer containing 10 mg/m$^2$ bis-(2-ethylhexyl)sulfosuccinic acid ester, as an extender, 15 mg/m$^2$ formalin, as a hardener, and 8 mg/m$^2$ glyoxal, was coated and dried on the emulsion layer so that the amount of gelatin coated would be 1.0 g/m$^2$, to yield a sample.

Sensitizing dye A

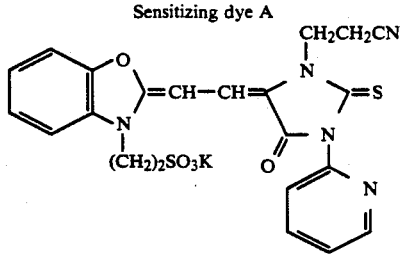

Sensitizing dye B

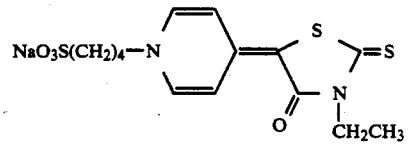

Compound C

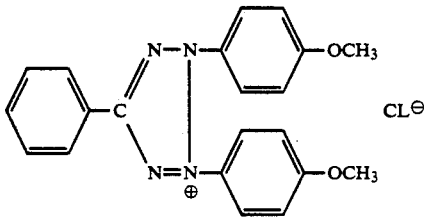

Preparation of Processing Composition

Developer Composition (for 1 liter of solution)

| | |
|---|---|
| Composition A | |
| 1. Water-soluble polymer or another granulation binder | See Table 1 |
| 2. Disodium ethylenediaminetetraacetate | 1.0 g |
| 3. Sodium sulfite | 24.4 g |
| 4. Phenidone | 0.5 g |
| 5. Hydroquinone | 15.0 g |
| 6. 5-methylbenzotriazole | 0.2 g |
| 7. 1-phenyl-5-mercaptotetrazole | 0.02 g |
| 8. 5-nitroindazole | 0.06 g |
| Composition B | |
| 10. Water-soluble polymer or another granulation binder | See Table 1 |
| 11. Sodium carbonate | 9.2 g |
| 12. Potassium bromide | 9.0 g |
| 13. Sodium sulfite | 15.6 g |
| 14. 5-nitroindazole | 0.06 g |
| 15. Sodium hydroxide | 7.4 g |

On the basis of the above compositions, a cylindrical granular processing composition 1 mm in diameter and 1.5 mm in length (both expressed as average value) was prepared by extrusion granulation in the presence of a water-soluble polymer shown in Table 1 or water, as a binder, for a batch of 1000 liters. Also obtained were tabular tablets 2 cm in diameter and 5 mm in thickness by compressive forming (central thickness was set at 2 mm for improved solubility). In some samples vacuum drying was conducted as shown in the table to reduce the water content in the granulation product to about 0.5%. The binder was added in a thermally molten state. The activity of developing agent, which varies depending on the kind or amount of the water-soluble polymer, was regulated by altering the amount of phenidone or hydroquinone on the basis of the results of the preliminary experiment. Granule or tablet strength test 100 g of each sample obtained was weighed out into a plastic box of 5×5×15 cm. After tight sealing, the box was vertically shaken at a cycle of 100 times/min for a distance of 5 cm for 5 minutes. Then, the sample was taken out from the box, and the amount of residual powder in the box was macroscopically evaluated. Evaluation criteria were: rank A for almost no residual powder, rank E for powder adhesion onto almost the entire surface of the box wall, and ranks B, C and D therebetween.

Storage Stability Test

A given amount of each sample was weighed out and placed in an aluminum-coated polyethylene sheet. After tightly sealing the polyethylene sheet, a heat treatment was conducted at 40° C. for 10 days.

Each sample thus treated was dissolved in water in accordance with the standard procedure and then used to process the above-mentioned silver halide photographic lightsensitive material under the following conditions.

The light-sensitive material sample described above was subjected to 1 second of exposure through an optical wedge using a tungsten lamp, after which it was processed with each processing agent using an automatic developing machine under the following conditions.

| Procedure | Processing conditions Temperature (°C.) | Time (seconds) |
|---|---|---|
| Development | 28 | 15 |
| Fixation | 28 | About 15 |
| Washing | Normal temperature | About 12 |
| Drying | 50 | 10 |

Table 1 shows the photographic performance of the processed samples. Figures for gamma value are expressed as the tangent of the linear portion between 0.2 and 1.5 of optical density; figures for sensitivity are expressed relative to the reciprocal of the amount of exposure providing a density of 2.0.

TABLE 1

| Sample No. | Granulation binder | Binder melting point (°C.) | Amount of binder used (% by weight), relative to the total solid content | Water (% by weight), relative to the total solid content | Drying process | Granulation product shape | Amount of residual powder (rank) | Not heated Sensitivity | Not heated Gamma value | Heated Sensitivity | Heated Gamma value | Remark |
|---|---|---|---|---|---|---|---|---|---|---|---|---|
| 1 | None | — | — | 3 | Yes | Granular* | E | 85 | 3.5 | 83 | 3.5 | Comparative |
| 2 | Polyvinyl alcohol (MW about 115000) | Over 100° C. | 5 | — | No | Granular* | E | 95 | 5.5 | 90 | 5.2 | Comparative |

TABLE 1-continued

| Sample No. | Granulation binder | Binder melting point (°C.) | Amount of binder used (% by weight), relative to the total solid content | Water (% by weight), relative to the total solid content | Drying process | Granulation product shape | Amount of residual powder (rank) | Not heated Sensitivity | Not heated Gamma value | Heated Sensitivity | Heated Gamma value | Remark |
|---|---|---|---|---|---|---|---|---|---|---|---|---|
| 3 | Polyvinyl alcohol (MW about 115000) | Over 100° C. | 10 | — | No | Granular* | E | 97 | 6.7 | 94 | 6.4 | Comparative |
| 4 | Polyvinyl alcohol (MW about 115000) | Over 100° C. | 20 | — | No | Granular* | E | 100 | 8.5 | 98 | 8.3 | Comparative |
| 5 | Polyvinyl alcohol (MW about 115000) | Over 100° C. | 10 | 3 | Yes | Granular | D | 100 | 6.8 | 98 | 6.7 | Comparative |
| 6 | Polyvinyl alcohol (MW about 115000) | Over 100° C. | 10 | 3 | No | Granular | E | 98 | 6.5 | 42 | 3.2 | Comparative |
| 7 | Polyethylene glycol (MW about 600) | 25° C. | 5 | — | No | Granular | B | 82 | 7.5 | 65 | 5.0 | Comparative |
| 8 | Polyethylene glycol (MW about 600) | 25° C. | 10 | — | No | Granular* | C | 100 | 8.0 | 80 | 6.8 | Comparative |
| 9 | Polyethylene glycol (MW about 1000) | 36° C. | 5 | — | No | Granular | A | 90 | 6.4 | 78 | 6.9 | Inventive |
| 10 | Polyethylene glycol (MW about 1000) | 36° C. | 10 | — | No | Granular* | C | 98 | 6.5 | 83 | 7.0 | Inventive |
| 11 | Polyethylene glycol (MW about 3000) | 58° C. | 3 | — | No | Granular | A | 72 | 5.8 | 65 | 5.2 | Comparative |
| 12 | Polyethylene glycol (MW about 3000) | 58° C. | 5 | — | No | Granular | A | 97 | 8.5 | 96 | 8.5 | Inventive |
| 13 | Polyethylene glycol (MW about 3000) | 58° C. | 10 | — | No | Granular | A | 100 | 8.4 | 98 | 8.4 | Inventive |
| 14 | Polyethylene glycol (MW about 3000) | 58° C. | 30 | — | No | Granular | A | 102 | 8.4 | 101 | 8.3 | Inventive |
| 15 | Polyoxyethylene nonyl phenol ether (MW about 3000) | 63° C. | 3 | — | No | Granular | A | 70 | 6.2 | 62 | 4.5 | Comparative |
| 16 | Polyoxyethylene nonyl phenol ether (MW about 3000) | 63° C. | 5 | — | No | Granular | A | 103 | 8.4 | 98 | 8.4 | Inventive |
| 17 | Polyoxyethylene nonyl phenol ether | 63° C. | 10 | — | No | Granular | A | 98 | 8.3 | 98 | 8.3 | Inventive |

TABLE 1-continued

| Sample No. | Granulation binder | Binder melting point (°C.) | Amount of binder used (% by weight), relative to the total solid content | Water (% by weight), relative to the total solid content | Drying process | Granulation product shape | Amount of residual powder (rank) | Not heated Sensitivity | Not heated Gamma value | Heated Sensitivity | Heated Gamma value | Remark |
|---|---|---|---|---|---|---|---|---|---|---|---|---|
| | (MW about 3000) | | | | | | | | | | | |
| 18 | Polyoxyethylene nonyl phenol ether (MW about 3000) | 63° C. | 30 | — | No | Granular | A | 101 | 8.3 | 100 | 8.4 | Inventive |

*indicates granulation failure

As seen from the results in Table 1, granulation did not occur when using a granulation binder having a melting point of over 100° C., with an increased amount of residual powder in the packing material waste noted in the vibration test. Although the use of a small amount of water allows granulation, subjecting the granules to drying yields similar results to those obtained in the absence of water. If drying is not conducted, storage stability deteriorates considerably.

When using a binder having a melting point of under 40° C., photographic performance deteriorates in the case of small amounts, while granulated particle reaggregation occurs in the case of large amounts. Storage stability is not sufficient.

It is evident that the present invention has solved these problems.

Similar experimental results were obtained from tablets. Example 2

Three kinds of processing compositions were prepared. Developer composition (for 1 liter of solution)

| | |
|---|---|
| Composition A | |
| 1. Disodium ethylenediaminetetraacetate | 1.0 g |
| 2. Polyethylene glycol (molecular weight 1,000) | 4.0 g |
| 3. Sodium sulfite | 24.4 g |
| 4. Phenidone | 0.5 g |
| 5. Hydroquinone | 15.5 g |
| 6. 5-methylbenzotriazole | 0.2 g |
| 7. 1-phenyl-5-mercaptotetrazole | 0.02 g |
| 8. 5-nitroindazole | 0.06 g |
| Composition B | |
| 10. Polyethylene glycol (molecular weight 1,000) | 4.0 g |
| 11. Sodium carbonate | 9.2 g |
| 12. Potassium bromide | 9.0 g |
| 13. Sodium sulfite | 15.6 g |
| 14. 5-nitroindazole | 0.06 g |
| 15. Sodium hydroxide | 7.4 g |

On the basis of the above compositions, a granular processing agent was prepared for a batch of 1000 liters.

Composition 1

For both compositions A and B, a required amount was weighed out in this order and added directly to a kneader. Polyethylene glycol was added after melt with heating.

Composition 2

Compounds 6, 7 and 8 for composition A and compound 14 for composition B were dissolved in a small amount of methanol and sprayed into a kneader in which the other compounds had been weighed and kneaded.

Composition 3

Compound 2 for composition A was melted with heating, and compounds 6, 7 and 8 were dissolved therein, after which the solution was added to a kneader in which the other compounds had been weighed and kneaded.

For composition 2, compound 14 was dissolved in compound 10 and the solution was added to a kneader.

For all compositions 1, 2 and 3, 10 minutes of kneading was followed by granulation using an extrusion granulator to yield a granular processing agent 1 mm in diameter and 2 mm in length. From the granular processing agent thus obtained, 20 2-liter granule samples were taken, 10 of which were kept standing and the other 10 were tightly packed in an aluminum-coated polyethylene sheet and subjected to a heat treatment at 40° C. for 10 days. After dissolution in water in accordance with the standard procedure, each sample was used to process the light-sensitive material prepared in Example 1 after 1 second exposure through an optical wedge.

Processing comprised development at 28° C. for 20 seconds, fixation at about 28° C. for 30 seconds using CFL-857K fixer, produced by Konica Corporation, followed by washing and drying.

Table 2 shows variations in photographic performance.

TABLE 2

| Processing agent composition | | Kept standing Sensitivity | Kept standing Gamma value | Heated Sensitivity | Heated Gamma value |
|---|---|---|---|---|---|
| Composition A | Maximum | 132 | 8.2 | 128 | 8.2 |
| | Minimum | 71 | 6.5 | 70 | 6.4 |
| | Average | 102 | 7.8 | 100 | 8.0 |
| | α | 15.2 | 0.43 | 14.9 | 0.57 |
| Composition B | Maximum | 118 | 8.2 | 104 | 8.1 |
| | Minimum | 80 | 7.0 | 65 | 4.5 |
| | Average | 98 | 7.9 | 85 | 7.2 |
| | α | 9.8 | 0.11 | 10.2 | 1.3 |
| Composition C | Maximum | 102 | 8.2 | 101 | 8.2 |
| | Minimum | 98 | 8.2 | 96 | 8.1 |
| | Average | 100 | 8.2 | 99 | 8.2 |
| | α | 1.8 | 0 | 1.9 | 0.05 |

As seen from these results, inventive composition 3 yielded very narrow variation in photographic performance, having no problem in storage stability.

What is claimed is:

1. In a composition for developing a silver halide photographic light-sensitive material being tableted or granulated and including a developing agent, a developing inhibitor, a developing accelerator, an anti-silver sludge agent and a gamma regulator; the improvement which comprises the developing inhibitor being selected from the group consisting of 5-methylbenztriazole, 1-phenyl-5-mercaptotetrazole and 5-nitroindazole, and said binder comprising not less than 5% by weight of the total weight of said composition of a water-soluble or alkali-soluble polymer selected from the group consisting of a polyalkylene glycol, a polyvinyl alcohol, a polyvinylpyrrolidone, a polyoxyethylene alkyl ether, and a polyoxyethylene alkyl phenol ether and having a melting point of 40° C. to 100° C.

2. The composition of claim 1, wherein the content of said polymer is 5% to 40% by weight of the total weight of said composition.

3. The composition of claim 1, wherein said composition is granulated.

4. The composition of claim 1, wherein the content of said organic development inhibitor is not more than 1% by weight of the total weight of said composition.

5. The composition of claim 1, wherein said composition is produced by a process comprising steps of melting said polymer, dissolving said organic development inhibitor in said melted polymer, mixing said melted polymer containing said organic development inhibitor with the remaining components of said composition, and granulating or tableting said mixed composition.

6. The composition of claim 1 wherein said polymer is polyoxyethylene octyl phenol ether or polyoxyethylene nonyl phenol ether.

* * * * *